US006662815B2

(12) United States Patent
Tung

(10) Patent No.: US 6,662,815 B2
(45) Date of Patent: Dec. 16, 2003

(54) CANOPY SUPPORT FRAME FOR A SUNSHADE

(76) Inventor: Benson Tung, No. 587, Chien-Gong Road, San-Min, Kaohsiung (TW)

( * ) Notice: Subject to any disclaimer, the term of this patent is extended or adjusted under 35 U.S.C. 154(b) by 86 days.

(21) Appl. No.: 10/122,825

(22) Filed: Apr. 15, 2002

(65) Prior Publication Data

US 2003/0192580 A1 Oct. 16, 2003

(51) Int. Cl.[7] ..... A45B 11/00

(52) U.S. Cl. ..... 135/20.1; 135/21; 403/84; 403/90; 248/288.51

(58) Field of Search ..... 135/20.1, 21, 90, 135/98, 42; 403/90, 84, 112; 248/288.31, 288.51

(56) References Cited

U.S. PATENT DOCUMENTS

| | | | | | |
|---|---|---|---|---|---|
| 5,002,081 | A | * | 3/1991 | Stromeyer | 135/21 |
| 5,116,258 | A | * | 5/1992 | Vennik | 135/20.3 |
| 5,499,644 | A | * | 3/1996 | Geniele | 135/20.1 |
| 5,678,585 | A | * | 10/1997 | May | 135/20.1 |
| 5,785,069 | A | * | 7/1998 | Glatz | 135/20.1 |
| 5,845,665 | A | * | 12/1998 | Koehn | 135/98 |
| 5,937,882 | A | * | 8/1999 | Harbaugh | 135/20.3 |
| 6,014,980 | A | * | 1/2000 | Glatz | 135/20.1 |
| 6,152,156 | A | * | 11/2000 | Tung | 135/21 |
| 6,321,763 | B1 | * | 11/2001 | Ma | 135/20.1 |

FOREIGN PATENT DOCUMENTS

| | | | |
|---|---|---|---|
| DE | 3229776 | * | 4/1983 |

* cited by examiner

*Primary Examiner*—Winnie S. Yip
(74) *Attorney, Agent, or Firm*—Alan D. Kamrath; Rider Bennett, LLP

(57) ABSTRACT

A sunshade comprises a supporting rod, a tube supported by the supporting rod, an elbow connected to an end of the tube, and a canopy support frame. A vertical section of the elbow includes two spaced lugs having a space therebetween, an upper wall defining the space including a toothed section. The canopy support frame includes an upper support base having ribs attached thereto for supporting a canopy, a lower support base having stretchers attached thereto for supporting the ribs, and a suspension member fixed to the upper support base to move therewith. The suspension member includes a toothed portion for releasable engagement with the toothed section of the elbow. The toothed portion of the suspension member is engaged with the toothed section of the elbow when the canopy reaches a fully open state.

6 Claims, 9 Drawing Sheets

CANOPY SUPPORT FRAME FOR A SUNSHADE

BACKGROUND OF THE INVENTION

1. Field of the Invention

The present invention relates to a canopy support frame for a sunshade. In particular, the present invention relates to a canopy support frame for a sunshade that assures reliable opening of the canopy of the sunshade even if the sunshade is placed on an inclined surface.

2. Description of the Related Art

A sunshade may provide a comfortable space for outdoor activities. U.S. Pat. No. 6,152,156 to Tung issued on Nov. 28, 2000 discloses a sunshade with a tiltable canopy. As illustrated in FIGS. 8 and 9 of the drawings, the sunshade disclosed in U.S. Pat. No. 6,152,156 includes a supporting rod 12, a canopy support frame 2, and a canopy 3. An adjusting sleeve 14 is slidably mounted around the supporting rod 12. A holding sleeve 18 is pivotally connected to an upper end of the supporting rod 12. An arcuate tube 24 is slidably extended through the holding sleeve 18. An elbow 34 is mounted to a first end of the arcuate tube 24 and a reel 28 is mounted to a second end of the arcuate tube 24. A connecting rod 222 is connected between the second end of the arcuate tube 24 and the adjusting sleeve 14. An anchor 50 is releasably engaged in an anchor room 38 in a vertical section 36 of the elbow 34 to reliably retain the canopy support frame 2 in a desired tilting angle relative to the supporting rod 12. However, it was found that, when the supporting rod 12 is placed on an inclined surface, the longitudinal axis of the anchor room 38 is not located in the vertical direction such that the anchor 50 could not enter the anchor room 38 when required, as shown in FIG. 9. Further, it is not uncommon that the vertical section 36 of the anchor 34 is not aligned with the suspension member 44 in which the anchor 50 is mounted. As a result, the anchor 50 could not enter the anchor room 38 when required, resulting in malfunction when unfolding the sunshade.

SUMMARY OF THE INVENTION

An object of the present invention is to provide a canopy support frame for a sunshade that assures reliable opening of the canopy of the sunshade even if the sunshade is placed on an inclined surface. Further, the canopy can be reliably retained in its fully open state.

A sunshade in accordance with the present invention comprises:

a supporting rod having a lower end and an upper end;

a tube supported by the supporting rod and including a first end and a second end;

an elbow connected to the first end of the tube and including a vertical section and a horizontal section, the vertical section including two spaced lugs having a space therebetween, an upper wall defining the space including a toothed section, the lugs including aligned vertical guide holes;

a canopy support frame for supporting a canopy and including an upper support base having a plurality of ribs attached thereto for supporting the canopy, a lower support base having a plurality of stretchers attached thereto for supporting the ribs, and a suspension member fixed to the upper support base to move therewith, the suspension member including a suspension head having a toothed portion for releasable engagement with the toothed section of the elbow;

a pivot extending through the vertical aligned holes of the lugs and the suspension head, allowing relative pivotal movement between the suspension head and the elbow when the toothed section of the elbow is disengaged from the toothed portion of the suspension head;

a reel mounted to the second end of the tube and including a handle;

a cable having a first end connected to the handle and a second end connected to the lower support base, the cable being movable in a retracting direction and a releasing direction;

wherein when the handle is operated to release the cable in the releasing direction, the toothed portion of the suspension head is disengaged from the toothed section of the elbow while the canopy is folded, and when the handle is operated to retract the cable in the retracting direction, the toothed portion of the suspension head is engaged with the toothed section of the elbow when the canopy reaches a fully open state.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
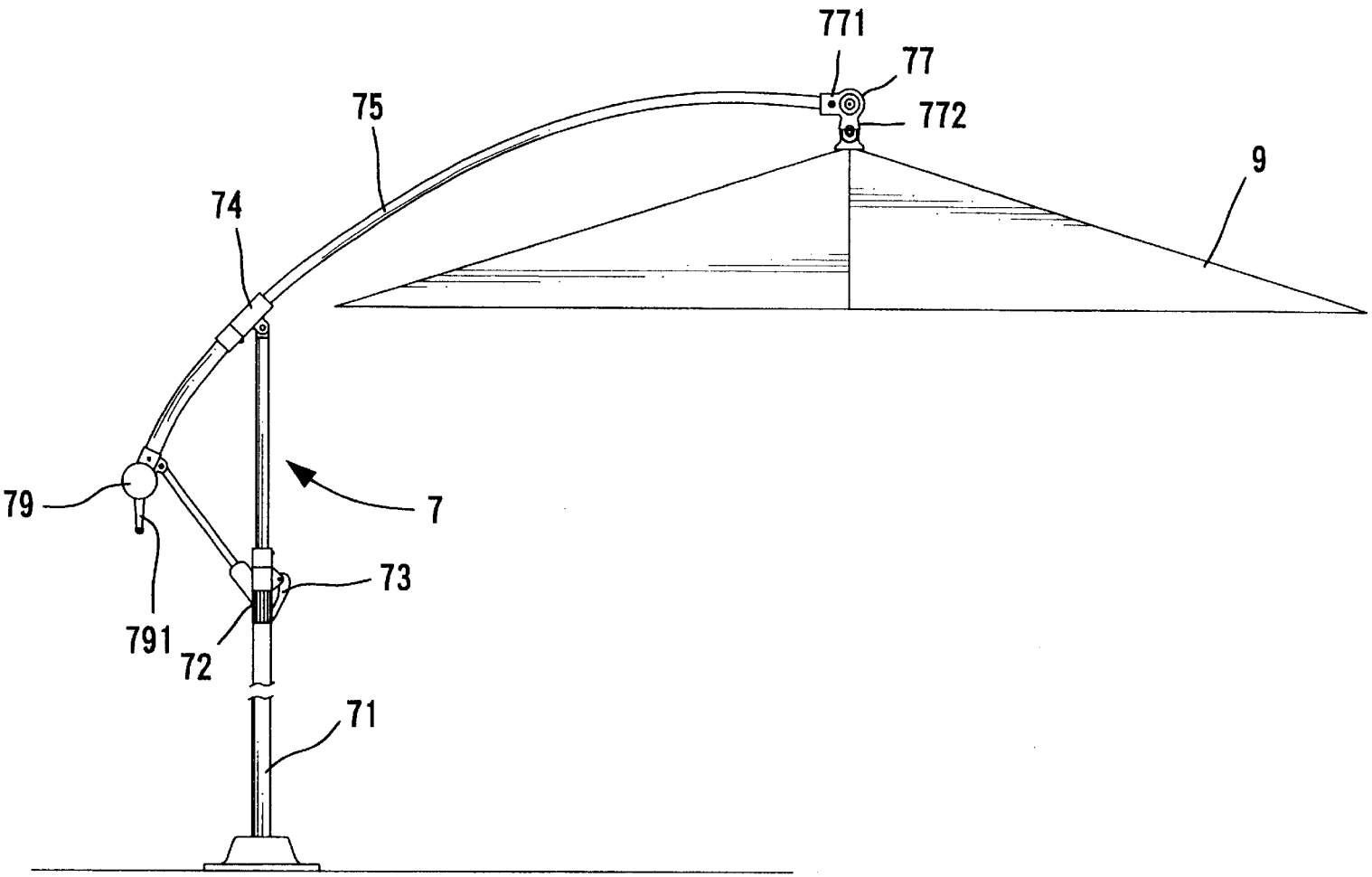
FIG. 1 is a side view of a sunshade with a canopy support frame in accordance with the present invention.

Referring to FIG. 1, a sunshade in accordance with the present invention generally includes a main frame 7, a canopy support frame 8 (FIG. 2), and a canopy 9. The main frame 7 includes a supporting rod 71, an adjusting sleeve 72 slidably mounted around the supporting rod 71, and a lever 73 mounted to the adjusting sleeve 72. When the lever 73 is in a locked position, the adjusting sleeve 72 is frictionally retained in place, and when the lever 73 is in a released position, sliding movement of the adjusting sleeve 72 relative to the supporting rod 71 is allowed. A holding sleeve 74 is pivotally connected to an upper end of the supporting rod 71. An arcuate tube 75 is slidably extended through the holding sleeve 74 and includes an elbow 77 mounted to a first end thereof and a reel 79 mounted to a second end thereof. The reel 79 includes a handle 791 for manual operation for folding or unfolding the canopy 9.

Figure 2:
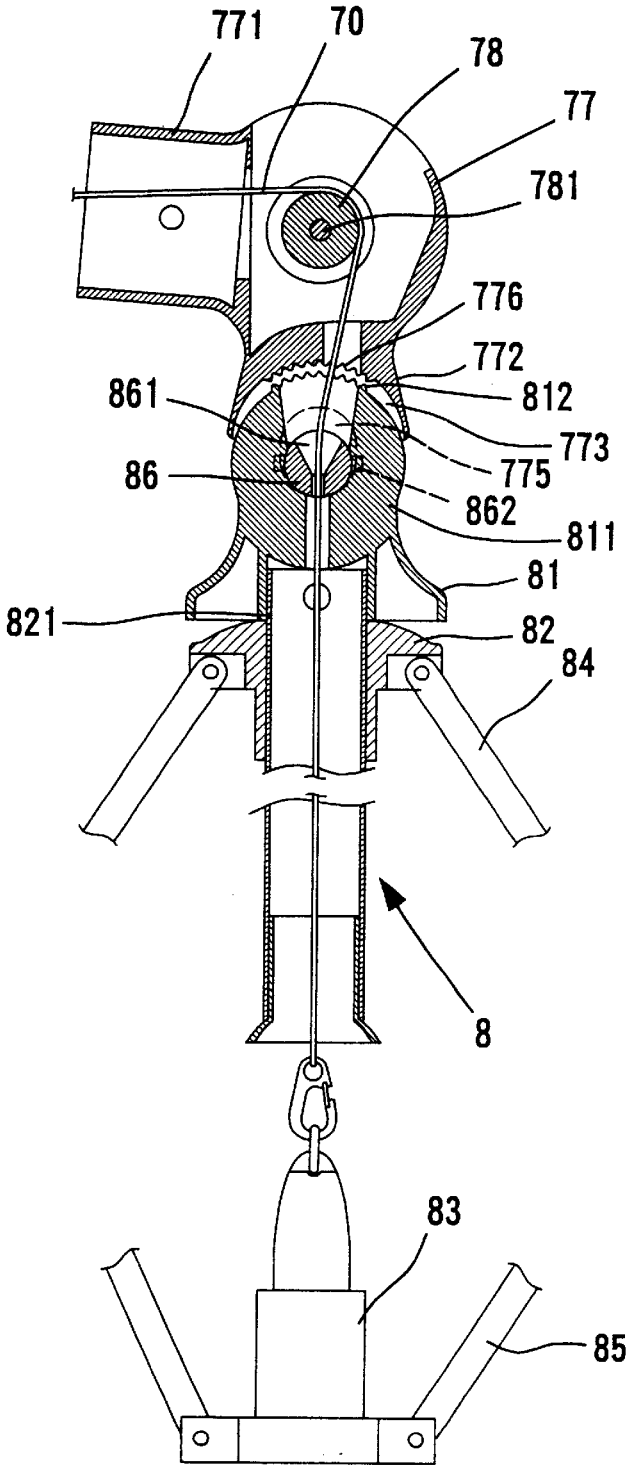
FIG. 2 is a sectional view of the canopy support frame in accordance with the present invention, wherein the canopy support frame is in a folded state.

Referring to FIG. 2, the canopy support frame 8 includes a suspension member 81, an upper support base 82 having a number of ribs 84 attached thereto for supporting the canopy 9, and a lower support base 83 having a number of stretchers 85 attached thereto for supporting the ribs 84. The elbow 77 includes a horizontal section 771 and a vertical section 772. A cable 70 includes a first end attached to and operable by the handle 791 of the reel 79 so as to be movable in a retracting direction and a releasing direction. A second end of the cable 70 is secured to an upper end of the lower support base 83 after wound through a pulley 78, which, in turn, is freely rotatably mounted in the elbow 70 by a pin 781. The upper support base 82 includes a tube 821 inserted into a lower end of the suspension member 81 to move therewith.

Figure 4:
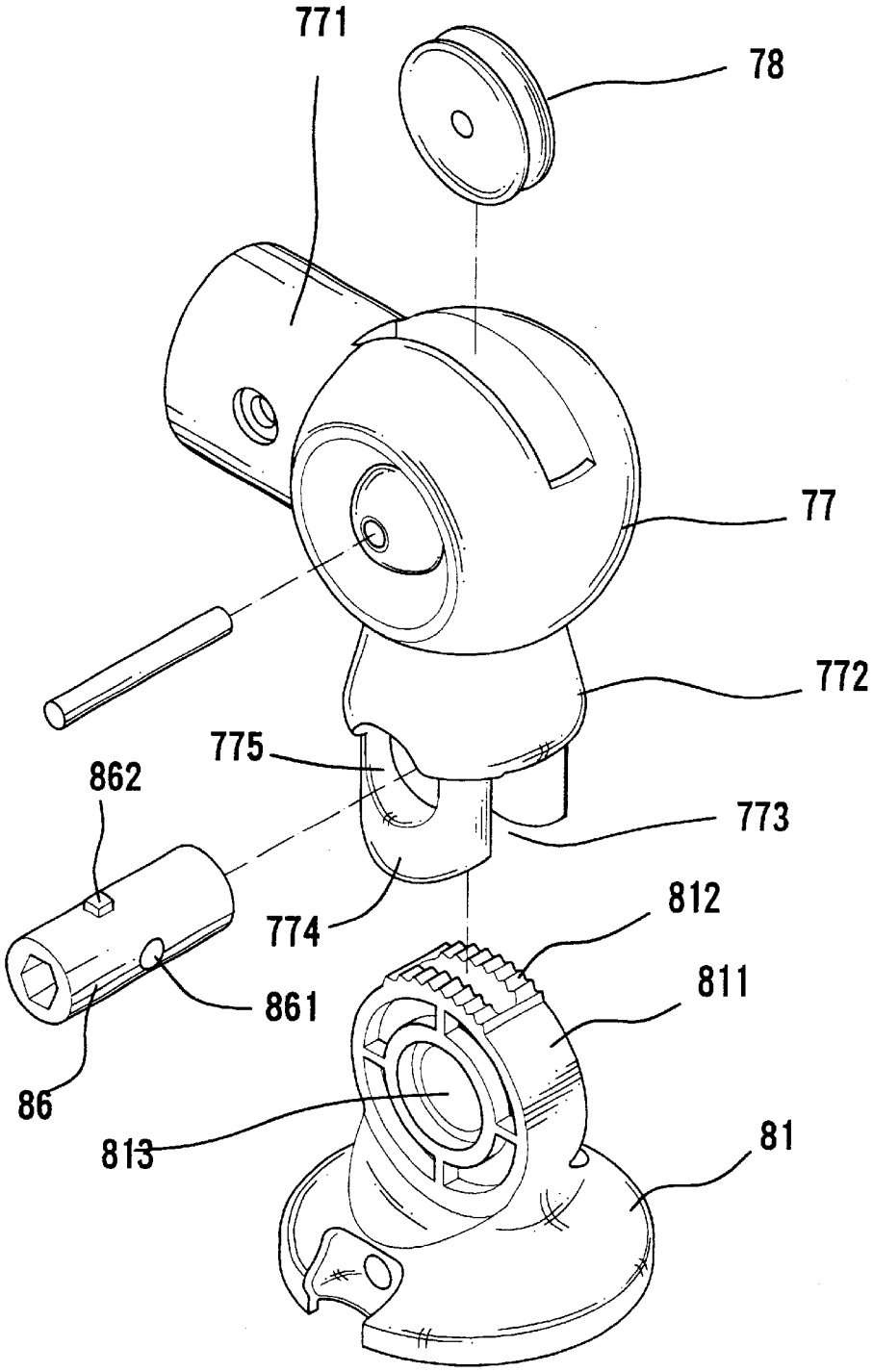
FIG. 4 is an exploded perspective view of an elbow and a suspension member of the canopy support frame in accordance with the present invention.

Of more importance, as can be seen from FIGS. 2 and 4, the vertical section 772 of the elbow 77 includes two spaced lugs 774 having a space 773 therebetween. An upper arcuate wall defining the space 773 includes a toothed section 776. Further, the lugs 774 include aligned vertical guide holes 775 that are preferably elongated.

A disc-like suspension head 811 is formed on an upper end of the suspension member 81 and is partially received in the space 773 between the lugs 774. A toothed portion 812 is formed on top of the suspension head 811 for releasable engagement with the toothed section 776 of the elbow 77. The suspension head 811 includes a transverse pivot hole 813. A pivot 86 is extended through the vertical guide holes 775 of the lugs 774 of the elbow 77 and the pivot hole 813 of the suspension head 811. Further, the pivot 86 is movable in the vertical guide holes 775 along a vertical direction.

Referring to FIG. 2, when the suspension member 81 is not subject to an upward force, the pivot 86 is located in lower ends of the vertical guide holes 775 with the toothed portion 812 of the suspension head 811 being disengaged from the toothed section 776 of the elbow 77. Thus, the suspension member 81 and the elbow 77 may pivot relative to each other.

Figure 3:
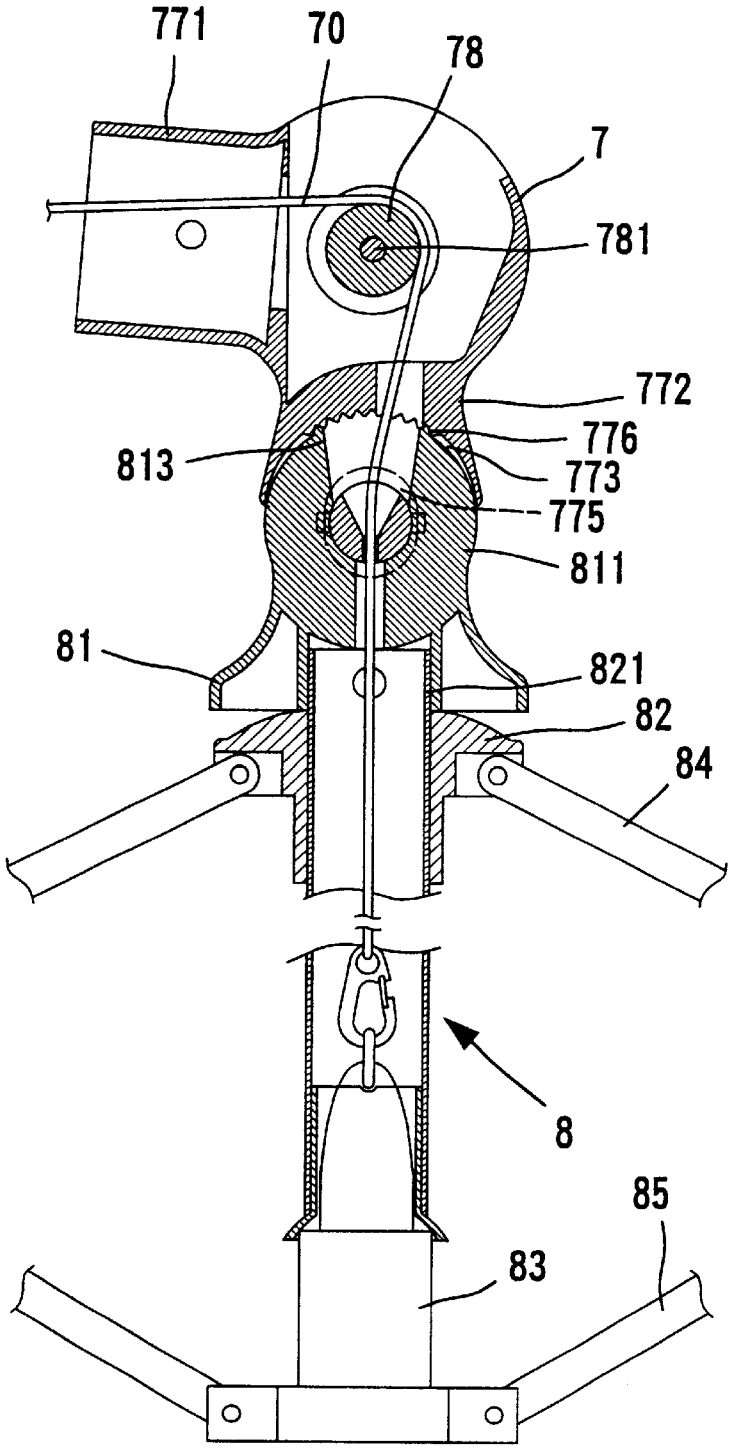
FIG. 3 is a sectional view similar to FIG. 2, wherein the canopy support frame is in a fully open state.

Referring to FIG. 3, when the suspension member 81 is subject to an upward force, the pivot 86 moves upward along the vertical guide holes 775 until the toothed portion 812 of the suspension head 811 engages with the toothed section 776 of the elbow 77. Thus, the canopy 9 is retained in its fully open (unfolded) state.

The canopy 9 of the sunshade in FIG. 1 is in a fully open state. When not in use, the user may operate the handle 791 to move the cable 70 in the releasing direction to thereby lower the suspension head 811 such that the suspension head 811 disengages from the elbow 77, and the canopy 9 collapses. Also, the user may operate the handle 791 to move the cable 70 in the retracting direction to unfold the canopy 9. It is noted that the lower support base 83 is moved upward by the retracting cable 70. When the canopy 9 reaches its fully open state, the suspension member 81 is moved together with the tube 821 of the upper support base 81, which, in turn, is moved upward by the lower support base 83. Thus, the toothed portion 812 of the suspension head 811 engages with the toothed section 776 of the elbow 77, thereby retaining the canopy 9 in its fully open state.

Figure 5:
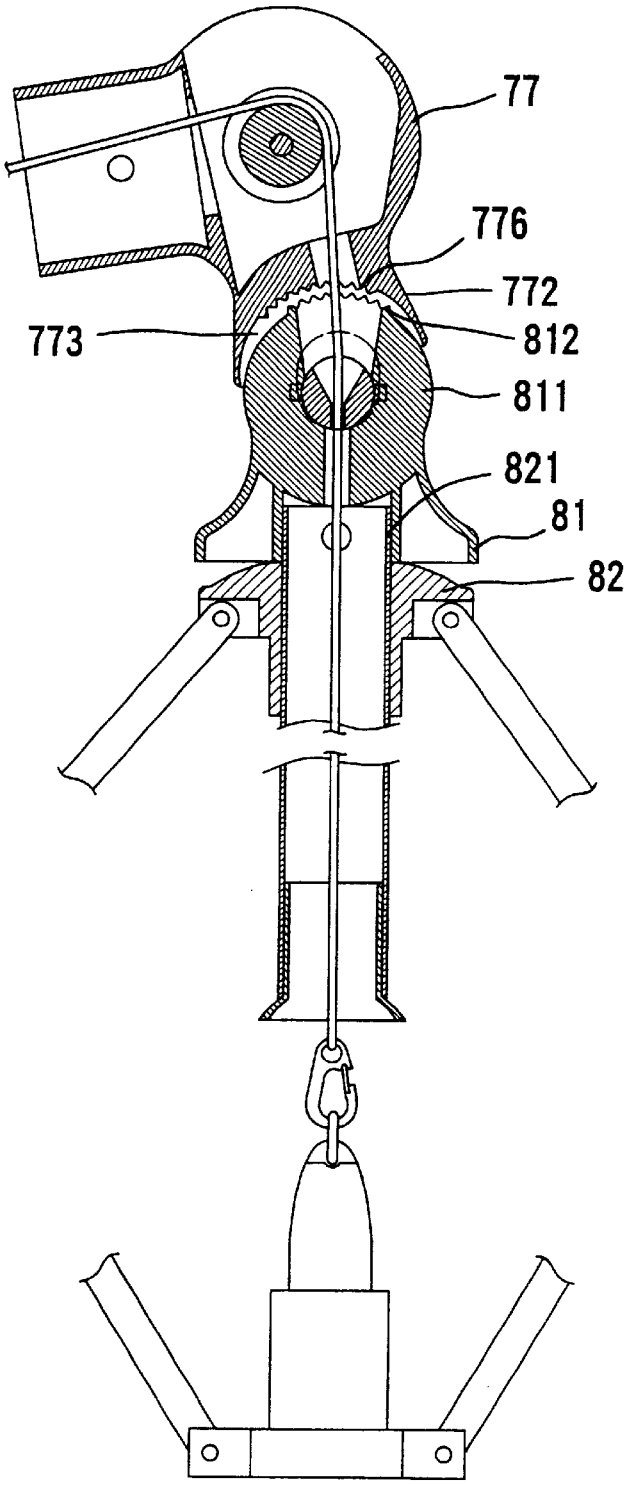
FIG. 5 is a view similar to FIG. 2, wherein the elbow is inclined relative to the suspension member.

When the supporting rod 71 in FIG. 1 is placed on an inclined surface, the elbow 77 is also inclined. As a result, as shown in FIG. 5, the vertical section 772 of the elbow 77 is not parallel to the longitudinal direction of the suspension member 81. In this case, referring to FIG. 6, when user operates the handle 791 to move the cable 70 in the retracting direction to open the canopy 9 and when the canopy 9 is in its fully open state, the suspension member 81 is moved together with the tube 821 of the upper support base 81, which, in turn, is moved upward by the lower support base 83. Thus, the toothed portion 812 of the suspension head 811 engages with the toothed section 776 of the elbow 77. Accordingly, reliable opening of the canopy 9 is assured and the canopy 9 is reliably retained in its fully open state even if the supporting rod 71 is placed on an inclined surface.

Referring to FIGS. 2 and 4, the pivot 86 includes a cable hole 861 through which the cable 70 extends. Two protrusions 862 are formed on an outer periphery of the pivot 86 and located on both sides of the cable hole 861. In assembly, the pivot 86 is inserted into the vertical guide holes 775 with the protrusions 862 being located in the vertical direction. When two ends of the pivot 86 are respectively located in the vertical guide holes 775, the pivot 86 is turned through 90 degrees until the cable hole 861 lies in the vertical direction, allowing the cable 70 to pass therethrough. Thus, the protrusions 862 are now located in the narrow width direction (i.e., horizontal direction) of the vertical guide holes 775. As a result, disengagement of the pivot 86 from the vertical guide holes 775 is prevented.

Figure 7:
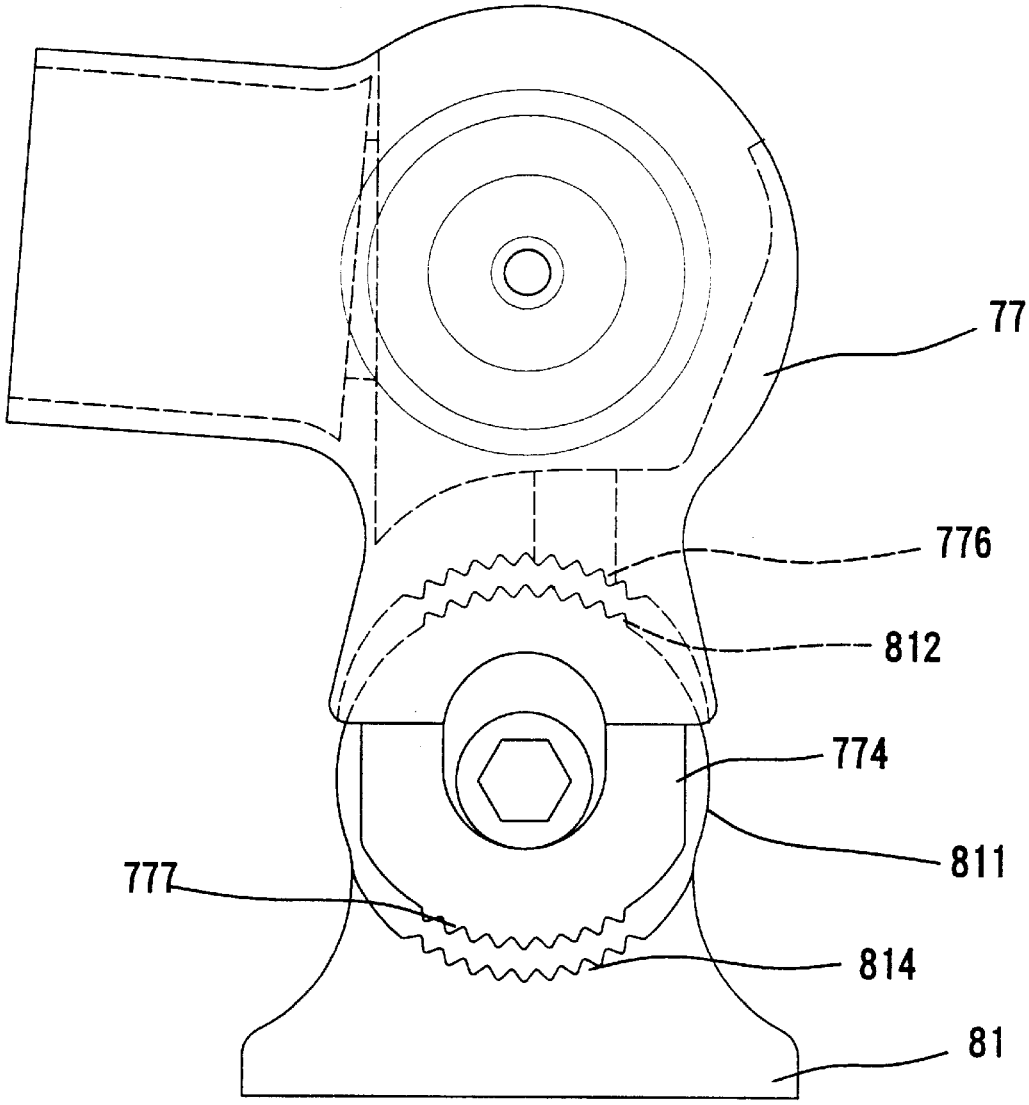
FIG. 7 is a schematic side view illustrating a modified embodiment of the canopy support frame in accordance with the present invention.
Figure 8:
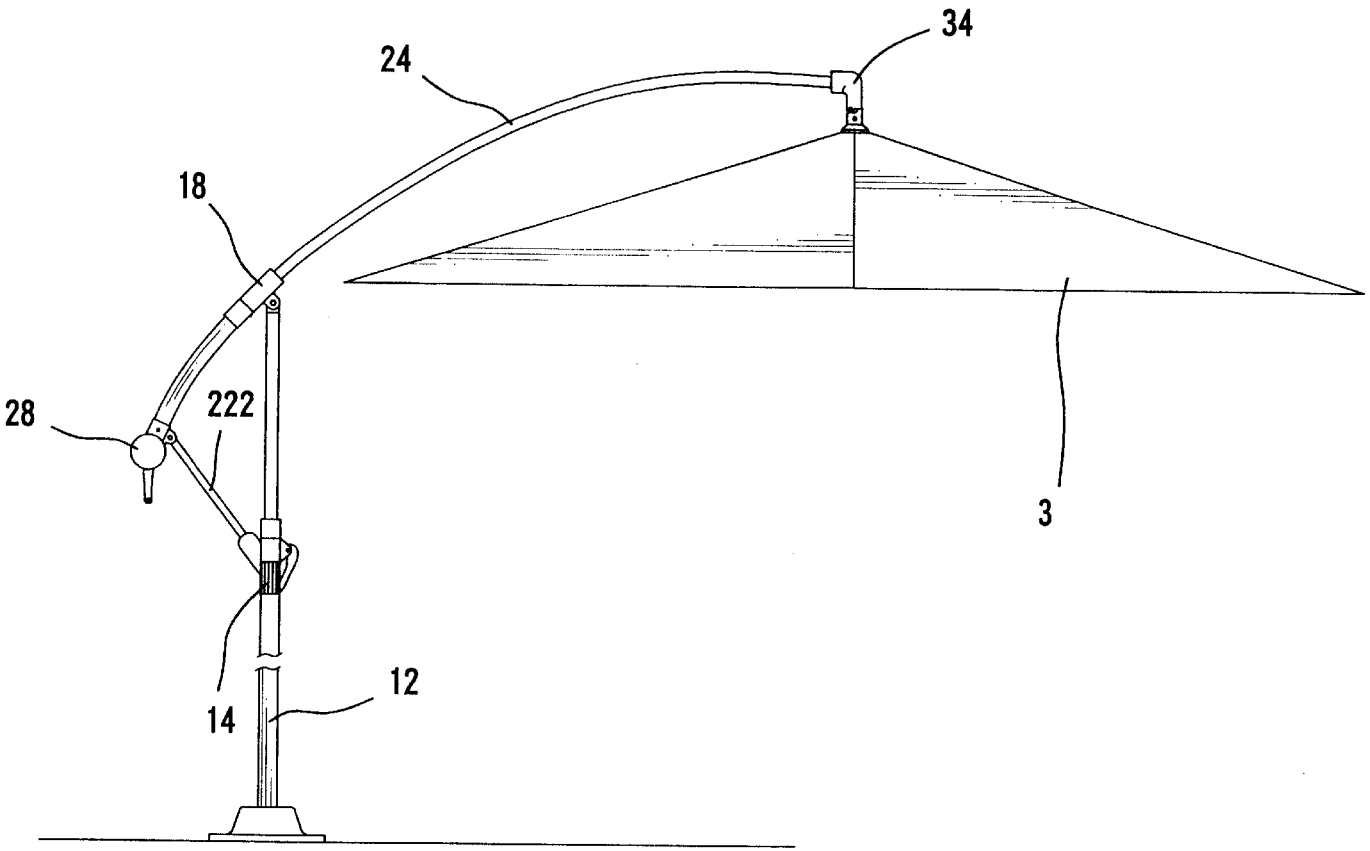
FIG. 8 PRIOR ART
FIG. 8 is a side view of a conventional sunshade with a tiltable canopy.
Figure 9:
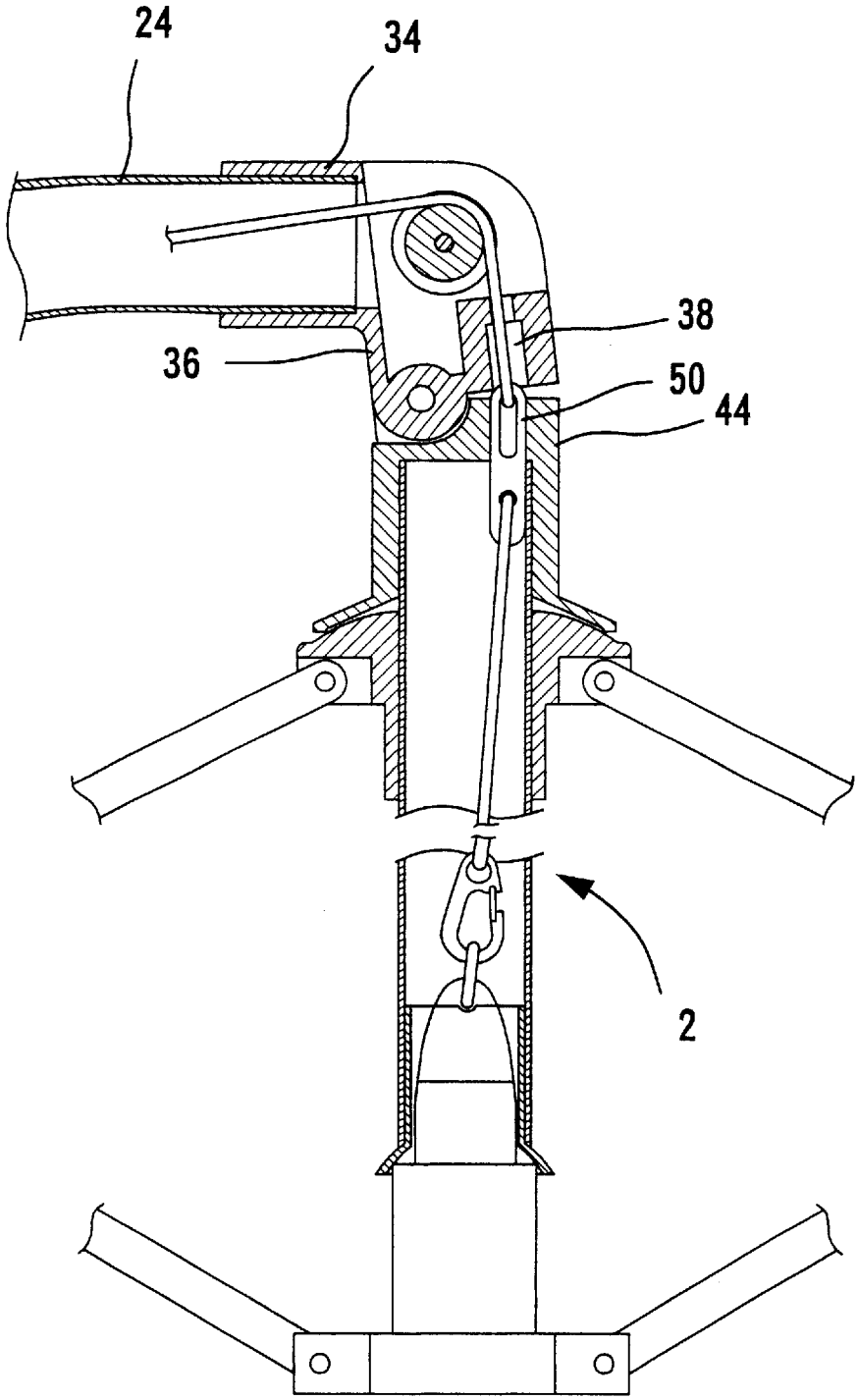
FIG. 9 PRIOR ART
FIG. 9 is a sectional view of a canopy support frame of the conventional sunshade in FIG. 8 on an inclined surface.

FIG. 7 illustrates a modified embodiment of the invention, wherein each lug 774 of the elbow 77 further includes a toothed section 777 on an underside thereof, and the suspension member 81 includes two toothed portions 814 on both sides of the suspension head 811 for respectively engaging with the toothed sections 777 of the lugs 774. This further assures reliable engagement between the elbow 77 and the suspension member 81.

The tilting angle of the canopy 9 can be adjusted. A typical example is disclosed in U.S. Pat. No. 6,152,156.

Figure 6:
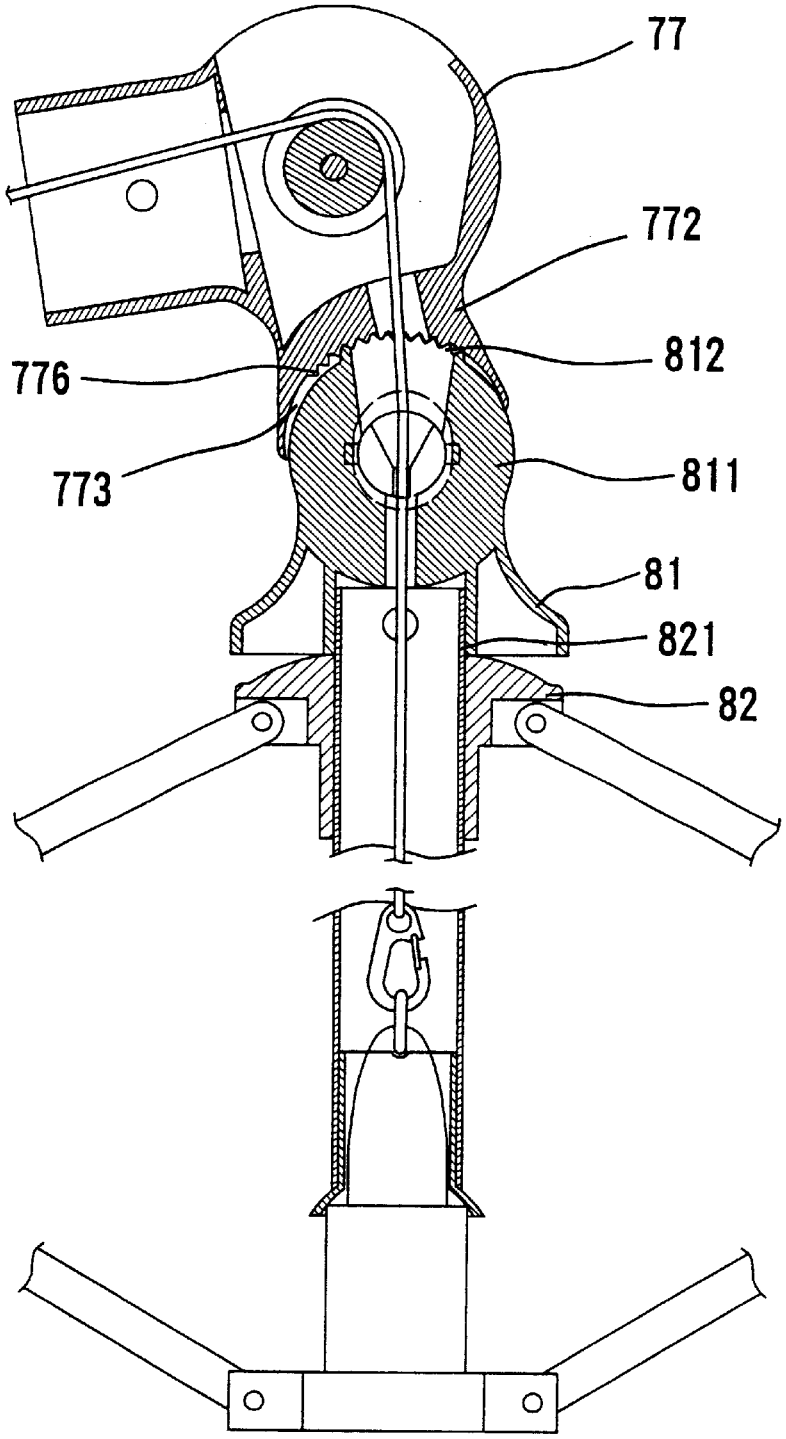
FIG. 6 is a view similar to FIG. 5, wherein the canopy support frame is fully opened.

According to the above description, it is appreciated that reliable opening of the canopy of the sunshade of the present invention is assured even if the supporting rod 71 is placed on an inclined surface. As illustrated in FIGS. 5 and 6, the toothed portion 812 of the suspension head 811 may engage with the toothed section 776 of the elbow 77 even if the vertical section 772 of the elbow 77 is at a large angle with the longitudinal axis of the suspension member 81.

Although the invention has been explained in relation to its preferred embodiment, it is to be understood that many other possible modifications and variations can be made without departing from the scope of the invention as hereinafter claimed.

What is claimed is:

1. A sunshade comprising:

a supporting rod having a lower end and an upper end;

a tube supported by the supporting rod and including a first end and a second end;

an elbow connected to the first end of the tube and including a vertical section and a horizontal section, the vertical section including two spaced lugs having a space therebetween, an upper wall defining the space including a toothed section, the lugs including aligned vertical guide holes;

a canopy support frame for supporting a canopy and including an upper support base having a plurality of ribs attached thereto for supporting the canopy, a lower support base having a plurality of stretchers attached thereto for supporting the ribs, and a suspension member fixed to the upper support base to move therewith, the suspension member including a suspension head having a toothed portion for releasable engagement with the toothed section of the elbow;

a pivot extending through the vertical aligned holes of the lugs and the suspension head, allowing relative pivotal movement between the suspension head and the elbow when the toothed section of the elbow is disengaged from the toothed portion of the suspension head;

a reel mounted to the second end of the tube and including a handle, a cable having a first end connected to the handle and a second end connected to the lower support base, the cable being movable in a retracting direction and a releasing direction;

wherein when the handle is operated to release the cable in the releasing direction, the toothed portion of the suspension head is disengaged from the toothed section of the elbow while the canopy is folded, and when the handle is operated to retract the cable in the retracting direction, the toothed portion of the suspension head is engaged with the toothed section of the elbow when the canopy reaches a fully open state.

2. The sunshade as claimed in claim 1, wherein the upper wall defining the space between the lugs is arcuate, and the suspension head is disc-like and partially received in the space.

3. The sunshade as claimed in claim 1, wherein the vertical guide holes of the lugs are elongated.

4. The sunshade as claimed in claim 1, wherein each said lug of the elbow further includes a second toothed section on an underside thereof, and the suspension member includes two toothed portions on both sides of the suspension head for respectively engaging with the second toothed sections of the lugs.

5. The sunshade as claimed in claim 3, wherein the pivot includes a cable hole through which the cable extends.

6. The sunshade as claimed in claim 5, wherein the pivot includes two protrusions formed on an outer periphery thereof and located on both sides of the cable hole, wherein the pivot is insertable into the vertical guide holes with the protrusions being located in a vertical direction and then rotated through 90 degrees when two ends of the pivot are respectively located in the vertical guide holes, thereby preventing disengagement of the pivot from the elbow.

* * * * *